US009722344B1

(12) United States Patent
Hamilton

(10) Patent No.: US 9,722,344 B1
(45) Date of Patent: Aug. 1, 2017

(54) SAFETY SHIELD FOR AN ELECTRIC PLUG

(71) Applicant: James T. Hamilton, Carmel, IN (US)

(72) Inventor: James T. Hamilton, Carmel, IN (US)

( * ) Notice: Subject to any disclaimer, the term of this patent is extended or adjusted under 35 U.S.C. 154(b) by 0 days.

(21) Appl. No.: 15/055,688

(22) Filed: Feb. 29, 2016

(51) Int. Cl.
*H01R 13/44* (2006.01)
*H01R 13/447* (2006.01)

(52) U.S. Cl.
CPC ..... *H01R 13/447* (2013.01)

(58) Field of Classification Search
CPC ..... H01R 13/447
USPC ..... 439/149, 150, 915, 140
See application file for complete search history.

(56) References Cited

U.S. PATENT DOCUMENTS 3,147,055 A * 9/1964 Rubens ..... H01R 13/447 439/140
4,305,634 A * 12/1981 Lewis ..... H01R 13/44 439/140
5,423,689 A 6/1995 Valentino
5,944,542 A 8/1999 Lee
6,602,088 B1 * 8/2003 Zhu ..... H01R 13/65802 439/278
8,096,819 B1 1/2012 Rosero et al.
9,088,081 B2 * 7/2015 Hildebrandt ..... H01R 13/00

* cited by examiner

*Primary Examiner* — Phuong Dinh

(74) *Attorney, Agent, or Firm* — Maginot, Moore & Beck, LLP

(57) ABSTRACT

A safety shield is provided for use with an electrical plug engaged in a wall socket, the plug having two or more prongs extending from a plug body. The shield comprises a plate formed of an electrically insulating material, with two or more openings defined in the plate in alignment with the two or more prongs of the electrical plug, each opening sized for a snug fit with a corresponding prong. The plate defines a perimeter area around the two or more openings that is at least five times greater than a planar area bounded by the two or more openings.

8 Claims, 1 Drawing Sheet

SAFETY SHIELD FOR AN ELECTRIC PLUG

BACKGROUND

The present invention relates to the child-proofing of an electric plug, and specifically to a device that guards against inadvertent contact with the prongs of the electric plug during insertion or withdrawal of the plug from the electric outlet.

Many devices exist for "child-proofing" electric plugs and electrical outlets. In most cases, the plug and socket are encased in some structure that is difficult for a child to open. These structures provide a high degree of safety since the plug and socket are kept out of sight of the child.

However, hiding the danger does not provide any opportunity to teach the child about the dangers of touching live electrical contacts. Moreover, from an aesthetic standpoint, the child-proof devices are visually disruptive. From a practical standpoint, the existing child-proof enclosures are too cumbersome and unattractive for many people.

There is a need for a safety shield for an electric plug that does not mask the danger, but still prevents a child from contacting a live plug. There is also a need for a safety shield that is very simple to use and at least not aesthetically disturbing.

SUMMARY OF THE INVENTION

A safety shield is provided in the form of a plate formed of an electrically insulating material that is mounted directly on the prongs of an electrical plug. The plate is thin enough so that it does not interfere with solid electrical contact between the prongs of the plug and the wall socket contacts. The plate is sized so that a child cannot access the plug prongs when the plug is partially engaged within the socket. The plate may be formed of a resilient material that is pre-formed to be biased towards the socket so that as the plug is removed from the wall socket the plate partially shrouds the exposed electrical contact by bending slightly toward the socket.

The body of the plate defines two or more openings in alignment with the two or more prongs of the electrical plug. Each opening is sized for a snug fit with a corresponding prong. The plate defines a perimeter area around the two or more openings that is at least five times greater than a planar area bounded by the two or more openings.

DETAILED DESCRIPTION

Figure 1:
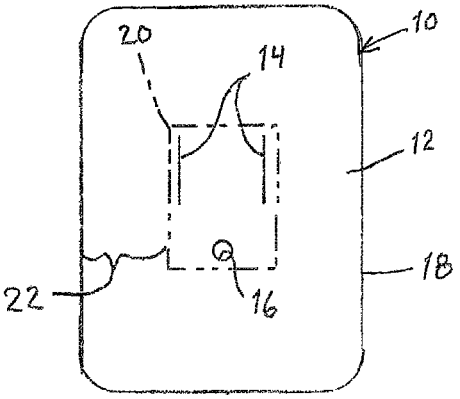
FIG. 1 is a plan view of a safety shield according to one aspect of the invention.

For the purposes of promoting an understanding of the principles of the disclosure, reference will now be made to the embodiments illustrated in the drawings and described in the following written specification. It is understood that no limitation to the scope of the disclosure is thereby intended. It is further understood that the present disclosure includes any alterations and modifications to the illustrated embodiments and includes further applications of the principles disclosed herein as would normally occur to one skilled in the art to which this disclosure pertains.

Figure 2:
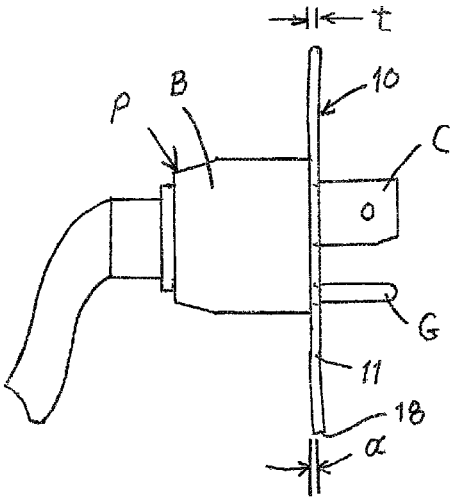
FIG. 2 is a side view of the safety shield shown in FIG. 1 installed on an electrical plug.

A safety shield 10 shown in FIG. 1 is a generally rectangular body 11 formed of an electrically insulating material. In one embodiment the body is formed of a food-grade silicone rubber. The body is sufficiently rigid to maintain its shape when mounted on an electrical plug, as shown in FIG. 2. The body has a thickness t that is thick enough for the shield 10 to maintain its shape without folding or bending excessively. The thickness t is also sufficiently thin so that the safety shield 10 does not compromise the electrical contact between the prongs C, G of the plug with the mating contacts in a wall socket. In one embodiment the thickness t is less than about ⅛ in., and in a preferred embodiment less than about 1/16 in. More importantly, the thickness t of the body is sufficient so that the body has a breakdown voltage sufficiently high to avoid arcing from a child's hand to an exposed prong that is still in electrical contact with a live wall socket. For a food-grade silicone rubber, the breakdown voltage for a 1/16 in. thick body is about 40,000 volts, which is more than sufficient to protect against electrical shock.

The body 12 defines two or more openings corresponding to the number of prongs on the electrical plug. In one embodiment, the body defines two slits 14 corresponding to the flat blade contacts C of the plug P, and a circular opening 16 corresponding to a conventional ground prong G. The openings 14, 16 are sized and configured for at least a snug fit with the corresponding prong C, G. More particularly, the openings are sized to resiliently grip the corresponding prong. Thus, in one embodiment, the openings 14 are thin slits that requires some force to manually push the flat blades C through the slits. Similarly, the opening 16 has a diameter less than the diameter of the ground prong G so that the ground prong requires some force to be manually pushed through the opening. The silicone rubber material of the plate 10 provides resilient grip to the body 11 that resists the movement of the prongs through the openings. The slits 14 and circular opening 16 are sized so that the prongs can be readily pushed through or removed from the openings by an adult, but there is sufficient resilient gripping force applied by the body 11 to prevent removal of the plate 10 from the electrical plug P by a child. In one embodiment, the circular opening 16 may be configured as an array of intersecting slits that separate as the ground prong G is pushed through.

The plate 10 may be provided with a pre-formed bias a so that the outer perimeter edge 18 is bent slightly away from the body B of the plug P. This bias a bends toward the wall socket so that when the plug is engaged to the socket the plate 10 forms an essentially flush contact with the wall socket or the wall in which the socket is mounted. The bias a can be minimal, as depicted in FIG. 2, or can be greater so that the plate 10 effectively shrouds the exposed electrical prongs C, G as the plug is removed from the socket. This pre-bias ensures that the prongs will always be covered when they are still in electrical contact with the socket to ensure that the child will not have direct access to the live prongs.

Figure 3:
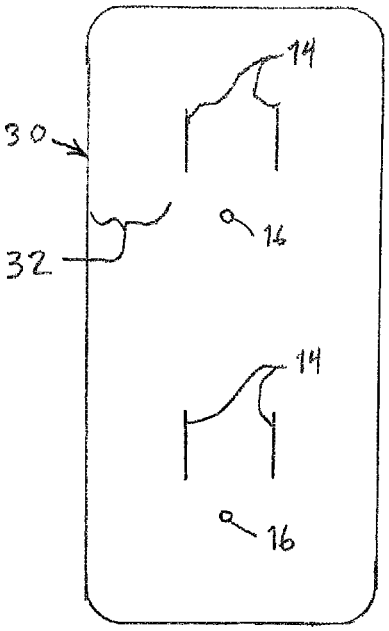
FIG. 3 is a plan view of a safety shield for use with a dual outlet socket.

The plate 10 is sized to cover the area around the plug P so that the child's hands cannot inadvertently touch the live prongs of the plug. Thus, the perimeter area 22 of the body around the openings 14, 16 is sufficiently large to accomplish this objective. In one embodiment, the perimeter area 22 is at least five times greater than the planar area 20 defined by the openings 14, 16. In the illustrated embodiment of FIG. 1, the perimeter area 22 is about eight times greater than the area 22 around the openings. In the dual plug embodiment shown in FIG. 3, the plate 30 has a perimeter area 32 that encircles both sets of openings, with each portion of the perimeter area associated with each set of openings being at least five times greater than the planar area around those openings.

The plate 10 or 30 can be readily mounted on one or two plugs by pressing the electrical prongs of the plugs through the corresponding openings 14, 16 in the plate. With the plate mounted to the plug P, the plug can be engaged into the wall socket in a conventional manner. The plate thickness t is thin enough that full electrical engagement can be maintained between the prongs and the wall socket contacts. While the plug is fully engaged in the socket, the plate 10 protects the electrical interface without hiding the electrical plug P. Moreover, since the plate is thin and generally sized to conform to the existing wall socket, the plate 10 will not disturb the aesthetic appearance at the wall socket. The plate 10 may even be provided with a design feature.

If a child attempts to remove the plug P form the wall socket, the plate 10 remains mounted to the plug P. The size of the plate prevents the child's hand from sliding from the body B of the plug P onto the live prongs C, G. Moreover, the size of the plate 10 prevents the child from having easy access to the live prongs with the other hand that is not gripping the plug.

The safety shield 10 can be easily stored when not in use. Since the plate 10 is thin, a stack of such plates can be easily stored and taken out for use when a child is expected to be near the plugs.

The present disclosure should be considered as illustrative and not restrictive in character. It is understood that only certain embodiments have been presented and that all changes, modifications and further applications that come within the spirit of the disclosure are desired to be protected.

What is claimed is:

1. A safety shield for use with an electrical plug engaged in a wall socket, the plug having two or more prongs extending from a plug body, the shield comprising:

a plate formed of an electrically insulating material;

two or more openings defined in the plate in alignment with the two or more prongs of the electrical plug, each opening sized for a snug fit with a corresponding prong; and the plate having a front surface for contact with the plug body with the prongs extending through the openings and an opposite back surface for contact with the wall socket when the plug is engaged in the wall socket, the plate defining a perimeter area around the two or more openings that is at least five times greater than a planar area bounded by the two or more openings, wherein the plate includes an additional two or more openings corresponding to an additional electrical plug having two or more electrical prongs; and wherein the perimeter area defined by the plate includes a first perimeter area defined around the two or more openings that is at least five times greater than a planar area bounded by the two or more openings and a second perimeter area defined around the additional two or more openings that is at least five times greater than a planar area bounded by the additional two or more openings.

2. The safety shield of claim 1, wherein the plate is formed of a silicone rubber.

3. The safety shield of claim 1, wherein the plate has a thickness between said front surface and said back surface that is less than ⅛ inch.

4. The safety shield of claim 3, wherein the thickness is less than 1/16 inch.

5. The safety shield of claim 1, wherein said two or more openings are configured to resiliently grip a corresponding prong extending therethrough.

6. The safety shield of claim 5, wherein said two or more openings include two slits spaced apart to receive two blade-shaped prongs.

7. The safety shield of claim 6, wherein said two or more openings further includes one circular opening sized to receive a ground prong of the electrical plug.

8. The safety shield of claim 1, wherein said plate is biased to bend away from the plug body when the safety shield is installed on an electrical plug.

* * * * *